US005197674A

United States Patent [19]

Ketterer et al.

[11] Patent Number: 5,197,674

[45] Date of Patent: Mar. 30, 1993

[54] APPARATUS FOR INJECTING A FUEL-GAS MIXTURE INTO AN INTERNAL COMBUSTION ENGINE

[75] Inventors: Wolfgang Ketterer, Ludwigsburg; Uwe Liskow, Kornwestheim; Harald Kalup, Bamberg, all of Fed. Rep. of Germany

[73] Assignee: Robert Bosch GmbH, Stuttgart, Fed. Rep. of Germany

[21] Appl. No.: 768,703

[22] PCT Filed: Jan. 19, 1991

[86] PCT No.: PCT/DE91/00046

§ 371 Date: Oct. 22, 1991

§ 102(e) Date: Oct. 22, 1991

[87] PCT Pub. No.: WO91/13253

PCT Pub. Date: Sep. 5, 1991

[30] Foreign Application Priority Data

Feb. 23, 1990 [DE] Fed. Rep. of Germany ..... 4005734

[51] Int. Cl.[5] ..... F02M 69/04

[52] U.S. Cl. ..... 239/408; 239/417.3; 239/585.4

[58] Field of Search ..... 239/408, 416.5, 417.3, 239/584, 585.4, 585.5, 409, 410; 123/531

[56] References Cited

U.S. PATENT DOCUMENTS

| | | | |
|---|---|---|---|
| 1,792,929 | 2/1931 | Remey | 239/585.5 |
| 2,623,786 | 12/1952 | Wille . | |
| 3,656,693 | 4/1972 | Eckert | 239/584 |
| 3,680,794 | 8/1972 | Romann et al. | 239/585.4 |
| 3,782,639 | 1/1974 | Boltz et al. . | |

FOREIGN PATENT DOCUMENTS

| | | | |
|---|---|---|---|
| 2819474 | 11/1978 | Fed. Rep. of Germany . | |
| 3320469 | 12/1984 | Fed. Rep. of Germany . | |
| 3604798 | 10/1986 | Fed. Rep. of Germany . | |
| 58-77162 | 5/1983 | Japan . | |
| 43962 | 3/1984 | Japan | 239/410 |

*Primary Examiner*—Andres Kashnikow
*Assistant Examiner*—William Grant
*Attorney, Agent, or Firm*—Edwin E. Greigg; Ronald E. Greigg

[57] ABSTRACT

The apparatus has a fuel injection valve with an injection end which rests on a bearing face of a stepped longitudinal bore. An annular gas conduit communicates with a gas source and an annular gas gap formed between the bearing face and a mixing chamber, and an exact, symmetrical, annular gas gap is formed between the injection end and the stepped longitudinal bore. The embodiment of the apparatus is especially suitable for use in internal combustion engines with externally supplied ignition.

20 Claims, 2 Drawing Sheets

APPARATUS FOR INJECTING A FUEL-GAS MIXTURE INTO AN INTERNAL COMBUSTION ENGINE

BACKGROUND OF THE INVENTION

The invention is based on an apparatus for injecting a fuel-gas mixture into an internal combustion engine as defined hereinafter. German Patent Disclosure Document DE-OS 36 09 798 already discloses an apparatus for injecting a fuel-gas mixture in which a recessed longitudinal bore of a valve holder fits around a fuel injection valve. Upstream of one injection end of the fuel injection valve, a mixing chamber is embodied in the valve holder, communicating upstream, via an annular gas gap formed between the injection end and the longitudinal bore, with an annular gas conduit that communicates with a gas source. However, this apparatus has the disadvantage that the size of the annular gas gap and the quality of centering of the fuel injection valve in the longitudinal bore of the valve holder are dependent on the tolerances in terms of length and shape of the fuel injection valve and of the longitudinal bore of the valve holder.

Because the guidance of the fuel injection valve in the longitudinal bore is at a pronounced distance from the injection end, the danger exists of canting and/or offset of the center axis of the fuel injection valve in the longitudinal bore of the valve holder and thus of an asymmetric embodiment of the annular gas gap and asymmetric injection of the fuel into the mixing chamber. Neither central injection of the fuel and thus the formation of a predominantly homogeneous fuel-gas mixture nor a requisite exact embodiment of the defined annular gas gap for the sake of precisely metered gas delivery is assured with any likelihood.

ADVANTAGES OF THE INVENTION

The apparatus according to the invention has an advantage over the prior art that the size of the annular gas gap and the quality of centering of the fuel injection valve in the longitudinal bore of the valve holder are independent of the length and shape tolerances of the fuel injection valve and of the valve holder. The position of the injection end of the fuel injection valve relative to the mixing chamber is defined in a simple manner directly at the injection end itself. The guidance of the fuel injection valve near its injection port enables not only the exact, symmetrical embodiment of the defined annular gas gap and thus the delivery of an accurately metered quantity of gas to the mixing chamber, but also a centered injection of the fuel into the mixing chamber and thus the formation of a predominantly homogeneous fuel-gas mixture.

The advantage in terms of installation of the apparatus according to the invention is that the fuel injection valves need not be selected with a view to their length and shape tolerances and matches to valve holders having certain longitudinal bores but can instead be installed arbitrarily. This considerably reduces production costs.

By means of the provisions recited herein, advantageous further developments of and improvements to the apparatus disclosed are possible.

It is especially advantageous if the bearing face of the longitudinal bore and the injection end of the fuel injection valve are embodied as tapering frustoconically radially with respect to the longitudinal axis of the valve, resulting in especially simple centering of the injection end of the fuel injection valve in the longitudinal bore of the valve holder.

It is advantageous if the annular gas gap is formed between the frustoconical injection end and an oblique segment of the longitudinal bore that tapers conically. Embodying the annular gas gap narrowly enables acceleration of the gas and thus improved mixing of the injected fuel with the delivered gas.

In order to embody a defined annular gas gap for delivery of an exact gas quantity at a predetermined acceleration, it is advantageous if the frustoconical injection end and the oblique segment extend parallel to one another.

It is also advantageous if the frustoconical injection end and the oblique segment converge in the direction of the mixing chamber, which produces particularly strong acceleration of the gas.

It is especially advantageous if the longitudinal bore between the bearing face and the oblique segment for forming the annular gas conduit has a larger diameter than the oblique segment, so that an annular gas collecting chamber is formed that enables uniform flow of the gas through the annular gas gap.

To embody an annular gas conduit serving the purpose of gas collection and enabling a uniform delivery of gas through the annular gas gap into the mixing chamber. it is advantageous if the injection end of the fuel injection valve has an indentation upstream of the annular gas gap.

In this embodiment, it is advantageous if the indentation of the injection end is formed by a parallel segment that begins at a conical segment of the gas gap and on the other end, via a shoulder, changes into a conical bearing face, because this not only makes production simple, but at the same time a large cross-sectional area of the annular gas gap possible.

With a view to simple production of a gas delivery conduit connecting the gas source to the annular gas conduit, it is advantageous if the gas delivery conduit discharges radially into the annular gas conduit.

For delivering the gas into the mixing chamber with a swirl and thus for improved mixing of gas and fuel, it is advantageous if the gas delivery conduit discharges into the annular gas conduit at a tangent.

DRAWING

Two exemplary embodiments of the invention are shown in simplified form in the drawing and described in further detail in the ensuing description.

FIG. 1 shows a first exemplary embodiment of an apparatus according to the invention, and FIG. 2 shows a second exemplary embodiment of an apparatus according to the invention.

DESCRIPTION OF THE EXEMPLARY EMBODIMENTS

Figure 1:
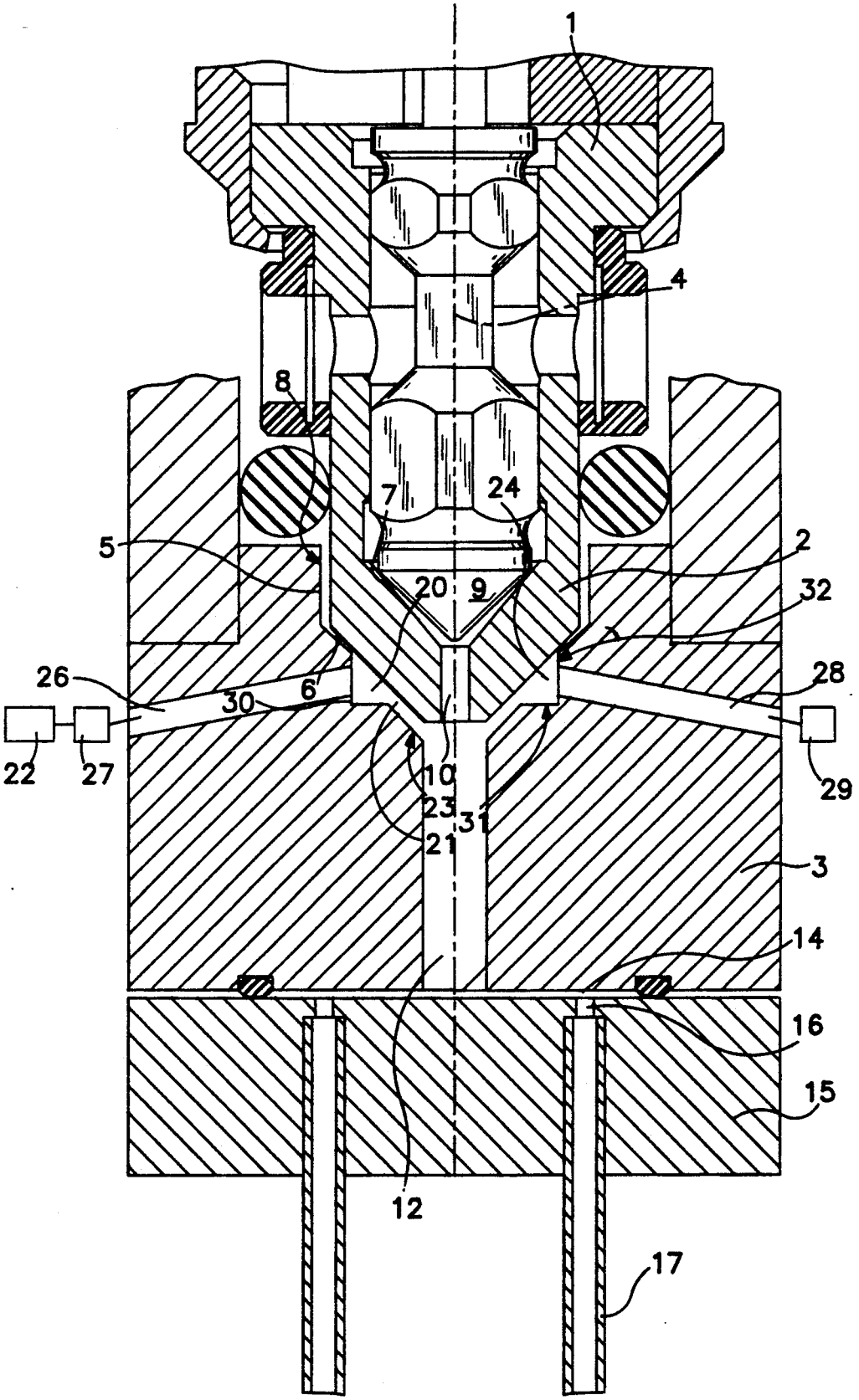

The apparatus for injecting a fuel-gas mixture into an intake tube of an internal combustion engine, shown by way of example in FIG. 1, has a fuel injection valve 1, which has an injection end 2 tapering frustoconically radially to a longitudinal valve axis 4, and a valve holder 3, which has a stepped longitudinal bore 5 extending concentrically with the longitudinal valve axis 4 and which fits around the injection end 2. The injection end 2 of the fuel injection valve 1 rests partly on a bearing face 6 of the valve holder 3 that originates at a cylindrical segment 8 of the longitudinal bore 5, tapers frustoconically radially to the longitudinal valve axis 4, and forms a segment of the longitudinal bore 5. The conical embodiment of the injection end 2 and bearing face 6 of the valve holder 3 effect a simple yet nevertheless highly exact centering of the injection end 2 of the fuel injection valve 1 in the longitudinal bore 5. The fuel injection valve 1 has a valve closing body 9 cooperating with a fixed valve seat 7. Downstream of the valve seat 7, the injection end 2 of the fuel injection valve 1 has one injection port 10, concentric with the longitudinal valve axis 4, but a plurality of injection ports may also be provided.

A cylindrical mixing chamber 12, into which the fuel is injected through the injection port 10 of the fuel injection valve 1, is embodied in the stepped longitudinal bore 5 downstream of the injection end 2 of the fuel injection valve 1. In the downstream direction, the mixing chamber 12 discharges into a distributor gap 14, which is embodied between the valve holder 3 and a distributor housing 15. The distributor gap 14 communicates with a number of distributor bores 16 equivalent to the number of cylinders of the engine; these bores carry the fuel-gas mixture on to the various cylinders, through the injection lines 17.

If there is one fuel injection valve 1 for each cylinder, in an exemplary embodiment not shown, then each mixing chamber 12 discharges directly into the injection line 17 of only a single cylinder.

Between the bearing face 6 of the valve holder 3 and the mixing chamber 12, an annular gas conduit 20, and adjoining the conduit 20 an annular gap or air gap 21, are embodied encompassingly, at least in the exemplary embodiment.

Embodying the annular gas gap 21 narrowly leads to an acceleration of the gas as it flows from the annular gas conduit 20 into the mixing chamber 12, so that better mixing of the gas and fuel in the mixing chamber 12 is attained. In the exemplary embodiment shown in FIG. 1, the annular gas gap 21 is formed between the frustoconical injection end 2 of the fuel injection valve 1 and a conically tapering oblique segment 23 of the longitudinal bore 5; the frustoconical injection end 2 and the oblique segment 23 extend parallel to one another. In the direction toward the mixing chamber 12, a continuous reduction in cross section forms, beginning at the annular gas conduit 20, because of the frustoconical faces of the oblique segment 23 and injection end 2 that taper toward the longitudinal axis 4 of the valve; this cross-sectional reduction provides for an additional acceleration of the flowing gas. For this reason, it is also possible, in a departure from the exemplary embodiment shown, for the frustoconical injection end 2 and the oblique segment 23 to converge toward one another in the direction of the mixing chamber 12, resulting in especially strong acceleration of the gas.

It is a prerequisite for the exact and symmetric embodiment of the annular gas gap 21 serving the purpose of gas metering that the injection end of the fuel injection valve 1 be centered accurately in the longitudinal bore 5 of the valve holder 3.

To form the annular gas conduit 20, the longitudinal bore, for instance between the bearing face 6 and the oblique segment 23, has a markedly larger diameter compared with the oblique segment 23, in the form of a recess 24, which is defined in the radial direction by a shoulder 31 and in the axial direction by a parallel segment 32. The annular gas conduit 20 serves as a collecting chamber for the delivered gas, so that a flow of the gas through the annular gas gap 21 into the mixing chamber 12 that is uniform and maximally symmetrical over the circumference of the annular gas gap 21 is made possible.

The delivery of the gas from a gas source 22 to the annular gas conduit 20 is effected by means of a gas delivery conduit 26 discharging radially into the annular gas conduit 20. A likewise possible tangential discharge of the gas delivery conduit 26 into the annular gas conduit 20 results in a delivery of the gas into the mixing chamber 12 with a pronounced swirl, and thus in an improved mixing of gas and fuel.

Either fresh air or an inert gas or a mixture of the two may be used as the gas for forming the fuel-gas mixture. The fresh air is for instance diverted from the intake line upstream of an arbitrarily adjustable throttle device and delivered directly to the gas delivery conduit 26. Engine exhaust gas may for instance be used as the inert gas, so that by this exhaust gas recirculation, toxic emissions of the engine are reduced.

Optionally, a feed pump 27 may also be provided, which reinforces the flow of the gas. To adjust this feed pump 27 or to adjust some other pressure generating device, a reference conduit 28 is embodied in the valve holder 3, as shown in FIG. 1; like the gas delivery conduit 26, the reference conduit communicates with the annular gas conduit 20. The reference conduit 28 communicates with a pressure regulator 29, which acts upon the feed pump 27 or some other pressure generating device. Like the gas delivery conduit 26, the reference conduit 28 also discharges radially and/or at a tangent into the annular gas conduit 20.

It is also possible to embody two or more gas delivery conduits 26 in the valve holder 3. Moreover, the gas delivery conduit 26 may communicate outside the valve holder 3 with a reference line communicating with the pressure regulator 29, so that a reference conduit 28 embodied in the valve holder 3 is unnecessary.

In the production of the valve holder 3 according to the invention from a metal material, the longitudinal bore 5 is embodied by metal-cutting machining; to reduce the manufacturing costs, the wall 30 of the annular gas conduit 20 in the longitudinal bore 5 between the bearing face 6 and the oblique segment 23 of the longitudinal bore 5 can be made by stamping.

Another possibility for producing a valve holder 3 according to the invention is to embody the valve holder 3 as a molded plastic part, resulting in low production costs.

Figure 2:
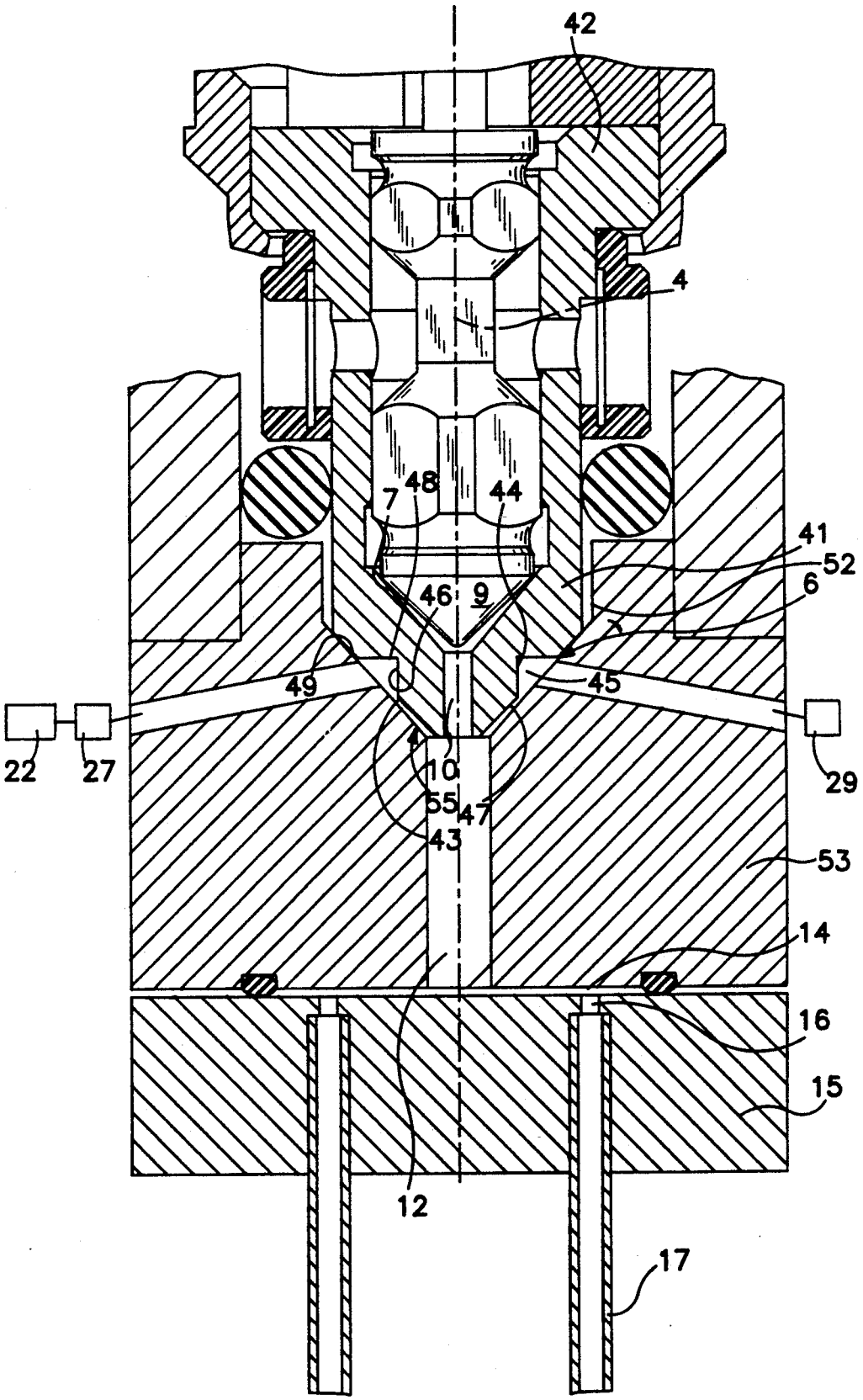

FIG. 2 shows a second exemplary embodiment of the invention, in which the elements that are the same and function the same are identified by essentially the same reference numerals as in FIG. 1. An injection end 41, tapering frustoconically radially to the longitudinal valve axis 4, of a fuel injection valve 42 has an indentation 44, serving to form an annular gas conduit 45, that begins at the injection port 10 upstream of an annular gas gap 43; the indentation is formed by a parallel segment 46, which begins at a conical segment 47 of the gas gap and on the other end, via a shoulder 48, changes into a conical bearing face 49 of the injection end 41. The fuel injection valve 42 rests with the conical bearing face 49 of the injection end 41 on the bearing face 6 of a stepped longitudinal bore 52 embodied concentrically with the longitudinal valve axis 4 in a valve holder 53. The annular gas gap 43 is formed between the conically extending conical segment 47 of the gas gap and an oblique segment 55 of the longitudinal bore 52 extending for instance parallel to the conical segment 47 and adjoining the bearing face 6, as has already been described in conjunction with the exemplary embodiment of FIG. 1.

While in the exemplary embodiment shown in FIG. 1 the longitudinal bore 5 of the valve holder 3 necessitates more-expensive production, it is the injection end 41 of the fuel injection valve 42 that requires this in the exemplary embodiment shown in FIG. 2.

The supply of the annular gas conduit 46 with gas is effected in the same way as has already been described for the exemplary embodiment of FIG. 1.

The resting of the injection end 2, 41 of the fuel injection valve 1, 42 on a bearing face 6 of the longitudinal bore 5, 52 and the embodiment of the annular gas conduit 20, 45 and annular gas gap 21, 43 between the bearing face 6 and the mixing chamber 12 enable both a centered injection of the fuel into the mixing chamber 12 and an exact, symmetrical embodiment of the defined annular gas gap 21, 43.

The foregoing relates to a preferred exemplary embodiment of the invention, it being understood that other variants and embodiments thereof are possible within the spirit and scope of the invention, the latter being defined by the appended claims.

We claim:

1. An apparatus for injecting a fuel-gas mixture into an intake tube of an internal combustion engine, having a fuel injection valve that includes a valve closing body, a fixed valve seat cooperating with said valve closing body, and downstream of the valve seat said fuel injection valve has at least one injection port at one injection end, a valve holder which embraces the fuel injection valve at least in a region of the injection end, the valve holder having a stepped longitudinal bore extending concentrically with a longitudinal valve axis, a mixing chamber is embodied downstream of the injection end in said valve holder, fuel is injected through the fuel injection valve into said mixing chamber, and said mixing chamber communicates upstream via an annular gas gap formed between the injection end and the stepped longitudinal bore, an annular gas conduit that communicates with a gas source and said annular gas gap, the injection end (2, 41) of the fuel injection valve (1, 42) rests on a bearing face (6) of the stepped longitudinal bore (5, 52) upstream of said annular gas conduit, said bearing face (6) of the stepped longitudinal bore (5, 52) and the injection end (2, 41) of the fuel injection valve (1, 42) are embodied as tapering frustoconically radially with respect to the longitudinal axis (4) of the valve, said annular gas conduit (20, 45) is embodied between the bearing face (6) and the mixing chamber (12) and said annular gas gap (21, 43) is formed between the frustoconical injection end (2, 41) and an oblique segment (23, 55) of the stepped longitudinal bore (5, 52) that tapers conically.

2. The apparatus as defined by claim 1, in which the frustoconical injection end (2, 41) and the oblique segment (23, 55) extend parallel to one another.

3. The apparatus as defined by claim 2, in which the annular gas conduit (45) is formed by an indentation (44) in the injection end (41) upstream of the annular gas gap (43).

4. The apparatus as defined by claim 3, in which the indentation (44) of the injection end (41) is formed by a parallel segment (46), which originates at a conical segment (47) of the gas gap and a shoulder (48) which changes into a conical bearing face (49).

5. The apparatus as defined by claim 2, in which a gas delivery conduit (26) connects the gas source (22) to the annular gas conduit (20, 45) and discharges radially into the annular gas conduit (20, 45).

6. The apparatus as defined by claim 3, in which a gas delivery conduit (26) connects the gas source (22) to the annular gas conduit (20, 45) and discharges radially into the annular gas conduit (20, 45).

7. The apparatus as defined by claim 1, in which the frustoconical injection end (2, 41) and the oblique segment (23, 55) converge toward one another in a direction toward the mixing chamber (12).

8. The apparatus as defined by claim 7, in which the annular gas conduit (45) is formed by an indentation (44) in the injection end (41) upstream of the annular gas gap (43).

9. The apparatus as defined by claim 8, in which the indentation (44) of the injection end (41) is formed by a parallel segment (46), which originates at a conical segment (47) of the gas gap and a shoulder (48) which changes into a conical bearing face (49).

10. The apparatus as defined by claim 7, in which a gas delivery conduit (26) connects the gas source (22) to the annular gas conduit (20, 45) and discharges radially into the annular gas conduit (20, 45).

11. The apparatus as defined by claim 1, in which the stepped longitudinal bore (5) forming the annular gas conduit (20) between the bearing face (6) and the oblique segment (23) has a larger diameter than the oblique segment (23).

12. The apparatus as defined by claim 1, in which a gas delivery conduit (26) connects the gas source (22) to the annular gas conduit (20, 45) and discharges radially into the annular gas conduit (20, 45).

13. The apparatus as defined by claim 1, in which the annular gas conduit (45) is formed by an indentation (44) in the injection end (41) upstream of the annular gas gap (43).

14. The apparatus as defined by claim 13, in which the indentation (44) of the injection end (41) is formed by a parallel segment (46), which originates at a conical segment (47) of the gas gap and a shoulder (48) which changes into a conical bearing face (49).

15. The apparatus as defined by claim 13, in which a gas delivery conduit (26) connects the gas source (22) to the annular gas conduit (20, 45) and discharges radially into the annular gas conduit (20, 45).

16. The apparatus as defined by claim 1, in which a gas delivery conduit (26) connects the gas source (22) to the annular gas conduit (20, 45) and discharges radially into the annular gas conduit (20, 45).

17. An apparatus for injecting a fuel-gas mixture into an intake tube of an internal combustion engine, having a fuel injection valve that includes a valve closing body, a fixed valve seat cooperating with said valve closing body, and downstream of the valve seat, said fuel injection valve has at least one injection port at one injection end, a valve holder which embraces the fuel injection valve at least in a region of the injection end, the valve holder having a stepped longitudinal bore extending concentrically with a longitudinal valve axis, a mixing chamber is embodied downstream of the injection end in said valve holder, fuel is injected through the fuel injection valve into said mixing chamber, and said mixing chamber communicates upstream via an annular gas gap formed between the injection end and the stepped longitudinal bore, an annular gas conduit, that communicates with a gas source and said annular gas gap, the injection end (41) of the fuel injection valve (42) rests on a bearing face (6) of the stepped longitudinal bore (52) upstream of said annular gas conduit, said bearing face (6) of the stepped longitudinal bore (5, 52) and the injection end (2, 41) of the fuel injection valve (1, 42) are embodied as tapering frustoconically radially with respect to the longitudinal axis (4) of the valve, said annular gas conduit (45) is formed by an indentation (44) in the injection end (41) upstream of the annular gas gap (43), and said annular gas conduit (45) and said annular gas gap (43) are embodied between the bearing face (6) and the mixing chamber (12).

18. The apparatus as defined by claim 17, in which an indentation (44) of the injection end (41) is formed by a parallel segment (46), which originates at a conical segment (47) of the gas gap and a shoulder (48) which changes into a conical bearing face (49).

19. The apparatus as defined by claim 18, in which a gas delivery conduit (26) connects the gas source (22) to the annular gas conduit (20, 45) and discharges radially into the annular gas conduit (20, 45).

20. The apparatus as defined by claim 17, in which a gas delivery conduit (26) connects the gas source (22) to the annular gas conduit (20, 45) and discharges radially into the annular gas conduit (20, 45).

* * * * *